US010246885B2

(12) United States Patent
Tchakarov

(10) Patent No.: US 10,246,885 B2
(45) Date of Patent: Apr. 2, 2019

(54) GROUTING PAN ASSEMBLY WITH REINFORCEMENT RING

(71) Applicant: DIAMOND TOOL SUPPLY, INC., Monroe, MI (US)

(72) Inventor: Tchavdar V. Tchakarov, Monroe, MI (US)

(73) Assignee: Husqvarna Construction Products North America, Inc., Charlotte, NC (US)

( * ) Notice: Subject to any disclaimer, the term of this patent is extended or adjusted under 35 U.S.C. 154(b) by 0 days.

(21) Appl. No.: 15/690,360

(22) Filed: Aug. 30, 2017

(65) Prior Publication Data

US 2017/0362836 A1 Dec. 21, 2017

Related U.S. Application Data

(60) Continuation-in-part of application No. 15/436,923, filed on Feb. 20, 2017, now Pat. No. 10,011,999, which is a division of application No. 14/490,012, filed on Sep. 18, 2014, now Pat. No. 9,580,916, application No. 15/690,360, which is a continuation-in-part of application No.

(Continued)

(51) Int. Cl.

| | |
|---|---|
| ***B24D 15/00*** | (2006.01) |
| ***E04F 21/24*** | (2006.01) |
| ***E04F 15/12*** | (2006.01) |
| ***B24D 7/06*** | (2006.01) |
| ***B24D 7/08*** | (2006.01) |
| ***B24D 13/14*** | (2006.01) |
| ***B24B 7/18*** | (2006.01) |

(52) U.S. Cl.

CPC ..... *E04F 15/126* (2013.01); *B24B 7/186* (2013.01); *B24D 7/066* (2013.01); *B24D 7/08* (2013.01); *B24D 13/147* (2013.01); *E04F 21/245* (2013.01)

(58) Field of Classification Search

None

See application file for complete search history.

(56) References Cited

U.S. PATENT DOCUMENTS 2,556,983 A 6/1951 Root
2,662,454 A * 12/1953 Whiteman ..... E04F 21/248 15/235.4

(Continued)

FOREIGN PATENT DOCUMENTS

WO WO-2008/065210 A1 6/2008

OTHER PUBLICATIONS

Diamond Tool Supply, Inc., "Floor Maintenance and Cleaning—Vortex" Catalog, (published on or before May 2013).

(Continued)

*Primary Examiner* — Cachet I Sellman

(74) *Attorney, Agent, or Firm* — Harness, Dickey & Pierce, PLC

(57) ABSTRACT

A grouting pan assembly includes a reinforcement ring. In another aspect, a grouting pan includes a substantially planar bottom surface and a curved sidewall surrounding the bottom surface. In a further embodiment, a grouting pan assembly includes a grouting pan having a post or mechanical fastener extending from a backside thereof for attachment to a reinforcing ring or layer.

35 Claims, 9 Drawing Sheets

Related U.S. Application Data

PCT/US2016/053355, filed on Sep. 23, 2016, application No. 15/690,360, which is a continuation-in-part of application No. 15/405,361, filed on Jan. 13, 2017.

(60) Provisional application No. 62/232,123, filed on Sep. 24, 2015.

(56) References Cited

U.S. PATENT DOCUMENTS 2,963,059 A * 12/1960 Grub ..... E04F 21/245 144/115
3,452,381 A * 7/1969 Bratti ..... E04F 21/248 15/230.16
3,591,884 A * 7/1971 Grueb ..... E04F 21/22 15/148
3,823,516 A 7/1974 Christian
4,271,557 A 6/1981 Caron
4,502,174 A 3/1985 Rones
4,724,567 A 2/1988 Rones
4,781,556 A 11/1988 Paul
4,939,872 A * 7/1990 Revelin ..... E04F 21/08 15/98
5,054,245 A * 10/1991 Coty ..... A47L 11/164 15/98
5,170,595 A 12/1992 Wiand
5,174,795 A * 12/1992 Wiand ..... B24B 7/22 451/530
5,372,452 A 12/1994 Hodgson
5,449,406 A * 9/1995 Presti, Jr. ..... E04F 21/248 118/244
5,452,853 A * 9/1995 Shook ..... B05B 13/0636 118/317
5,477,580 A * 12/1995 Buysse ..... A46B 13/008 15/180
D367,743 S 3/1996 Krause et al.
5,567,503 A 10/1996 Sexton et al.
5,605,493 A 2/1997 Donatelli et al.
5,607,345 A 3/1997 Barry et al.
5,632,570 A 5/1997 Balling
5,807,022 A * 9/1998 McCleary ..... E04F 21/20 404/101
5,882,249 A * 3/1999 Ferland ..... E04F 21/248 451/359
5,970,559 A 10/1999 Christy
6,234,886 B1 5/2001 Rivard et al.
6,371,842 B1 4/2002 Romero
6,382,922 B1 * 5/2002 Lewis ..... E04F 21/08 417/199.1
D510,850 S 10/2005 Boler, Jr.
6,971,821 B1 * 12/2005 Mansour ..... E02D 3/12 405/230
7,004,676 B2 2/2006 Williams
7,033,258 B2 4/2006 Jordan
7,059,801 B2 6/2006 Snyder et al.
7,144,194 B2 * 12/2006 Kipp, Jr. ..... E04F 21/248 404/112
7,147,548 B1 12/2006 Mehrabi
7,172,365 B2 2/2007 Lutz et al.
7,204,745 B2 4/2007 Thysell
7,261,623 B1 * 8/2007 Palushi ..... B24B 7/186 451/350
D559,063 S 1/2008 Okamoto et al.
7,326,106 B1 * 2/2008 Rogers ..... B24B 7/186 15/49.1
D576,855 S 9/2008 Okamoto et al.
D581,237 S 11/2008 Okamoto et al.
D584,591 S 1/2009 Tano et al.
7,506,644 B2 3/2009 Park
D592,029 S 5/2009 Tano et al.
D592,030 S 5/2009 Tano et al.
D600,989 S 9/2009 Tano et al.
7,674,069 B2 * 3/2010 Stenzel ..... E04F 21/247 404/112
7,713,109 B2 5/2010 Estes
7,744,447 B2 * 6/2010 Kodani ..... B24D 7/06 451/259
7,815,393 B2 10/2010 Snyder et al.
7,997,960 B2 8/2011 Williams, Sr.
8,176,909 B2 * 5/2012 Ilgner ..... B24B 7/186 125/38
8,192,255 B2 6/2012 Gallup et al.
D678,745 S 3/2013 Nguyen
D694,081 S 11/2013 Wright
8,790,164 B2 * 7/2014 Rivard ..... B24D 9/003 451/490
D731,448 S 6/2015 Kinoshita et al.
D732,917 S 6/2015 Valentini
9,050,625 B1 6/2015 Bonachea Ruiz
9,174,326 B2 11/2015 Ahonen
9,580,916 B2 2/2017 Tchakarov et al.
2001/0048854 A1 * 12/2001 Carter, Jr. ..... E02D 5/46 405/266
2003/0029132 A1 * 2/2003 Ward ..... E04D 1/36 52/742.16
2005/0172428 A1 8/2005 Thysell
2005/0227600 A1 10/2005 Fisher
2006/0073776 A1 * 4/2006 Gallup ..... B24B 7/186 451/353
2007/0254568 A1 11/2007 Park
2008/0108286 A1 5/2008 Thysell et al.
2008/0176498 A1 7/2008 Rossi et al.
2010/0240282 A1 * 9/2010 Young ..... B24B 1/00 451/28
2011/0300784 A1 * 12/2011 Tchakarov ..... B24B 7/186 451/259
2013/0225051 A1 8/2013 Vankouwenberg
2013/0324021 A1 12/2013 Ryan
2016/0083967 A1 3/2016 Tchakarov et al.

OTHER PUBLICATIONS

Diamond Tool Supply, Inc., "Tools for Concrete" Catalog, (published on or before May 2013).
Diamond Tool Supply, Inc., "Floor Maintenance and Cleaning—Monroe" Catalog, (published prior to Sep. 2014).
Diamond Tool Supply, Inc., "Tools for Stone" Catalog, (published prior to Sep. 2014).
Diamond Tool Supply, Inc., "Tools for Concrete" Catalog, (published prior to Sep. 2014).
HTC, "Professional Floor Systems" Product catalog 2014, www.htc-floorsystems.com, 2014.
HTC, "Professional Floor Systems" Product catalogue 2015, www.htc-floorsystems.com, 2015.
Wagman Metal Products Inc., "Concrete Finishing Tools" Catalog, (published prior to Sep. 23, 2016).

* cited by examiner

GROUTING PAN ASSEMBLY WITH REINFORCEMENT RING

CROSS-REFERENCE TO RELATED APPLICATIONS

This application is a continuation-in-part of U.S. patent application Ser. No. 15/436,923 filed on Feb. 20, 2017, which claims priority to U.S. patent application Ser. No. 14/490,012 filed on Sep. 18, 2014, issued as U.S. Pat. No. 9,580,916. This application is also a continuation-in-part of PCT international patent application serial no. PCT/US2016/053355 filed on Sep. 23, 2016 which claims priority to U.S. provisional patent application Ser. No. 62/232,123 filed on Sep. 24, 2015. Furthermore, this application is a continuation-in-part of U.S. patent application Ser. No. 15/405,361 filed on Jan. 13, 2017. The entire disclosures of the above applications are incorporated by reference herein.

FIELD

The present disclosure relates generally to finishing of workpiece surfaces, and more particularly to filling voids and/or pin holes in floor surfaces with a grouting pan assembly having a reinforcement ring.

BACKGROUND

Composite surfaces such as epoxy, terrazzo, or cementitious floors generally include a decorative aggregate most commonly marble chips or any suitable aggregate supported in a matrix material. First, a solid, level foundation typical of concrete is established. Next, a subflooring layer is formed on top of the foundation. Historically, this layer is a sandy concrete layer. Metal divider strips may be partially embedded in the concrete before it cures to provide panels in the surface. Finally, a top layer including the matrix material with the decorative aggregate is placed into each of the panels. Historically, the matrix material was a cementitious material but now may be a polymer-based matrix such as epoxy-based. The matrix material may be color-pigmented. The decorative aggregate, while typically marble chips, may be any suitable aggregate e.g., glass, porcelain, concrete, metal, mother of pearl, abalone. While the mixture is still wet, additional aggregate may be broadcast into various panels. Finally, the entire surface is rolled with a weighted roller.

As initially installed, these composite surfaces are porous or semi-porous in nature. Moreover, as the composite surface dries in the case of a cementitious matrix or cures in the case of polymer-based matrix, gases are released from the matrix causing surface imperfections, pin-holes and subsurface voids in the top layer. To address this concern, the top layer is rough cut using very course to course (24-grit to 80-grit) grinding stones or diamond plates. Rough cutting the top layer evens out the surface imperfections but may leave slight depressions. Rough cutting does little to remedy the pin holes and may open up subsurface voids to the surface. If left untreated, these flaws can collect excess wax, dirt and other debris which affects the look and surface quality of the composite surface.

Accordingly, it is necessary to grout the composite surface in an effort to fill the remaining surface imperfections. The rough cut layer is grouted by hand troweling a mortar onto the composite surface. The mortar is repeatedly wiped back and forth over the surface with a hand trowel. As the trowel approaches a surface imperfection, the mortar covers the indentations and partially fills the subsurface voids. However, as the trowel moves past the surface imperfection, the trowel can pull mortar out of the subsurface void, thus leaving surface imperfections. Even subsurface voids that have been covered with mortar may become exposed as the mortar dries or cures.

Accordingly, it is desirable to develop a method of grouting a rough cut floor which completely fills the surface imperfections. In addition, it is desirable to develop a tool useful in the grouting process and which is configured for use on the finishing machines typically used in conventional grinding and polishing of composite surface. Conventional pads also exhibit uneven flexibility especially at their peripheries.

SUMMARY

In accordance with the present invention, a grouting pan assembly includes a reinforcement ring. In another aspect, a grouting pan includes a substantially planar bottom surface and a curved sidewall surrounding the bottom surface. A further aspect provides a grouting pan with a curved side wall including an angled portion and a rounded edge portion formed between a bottom surface and an angled portion such that an obtuse included angle is formed therebetween. In yet another aspect, a top surface of a grouting pan is configured to affix the grouting pan to a rotating head of a finishing machine. In another embodiment, a grouting pan assembly includes a grouting pan having a post or other mechanical fastener extending from a backside thereof for attachment to a reinforcing ring or layer. Methods of making and using the present grouting pan assembly with a reinforcement ring or layer are also provided.

The present grouting pan assembly is ideally suited for finishing a composite or other workpiece surface. The present assembly may also spread mortar over a rough composite surface having surface voids to form a prepped surface. An exemplary grouting pan having a curved sidewall extending from a generally flat bottom surface in contact with the prepped floor is advantageously rotated over the prepped surface. By way of the rotary movement, the exemplary grouting pans are moved in different directions relative to the composite surface so that they are pushed across the surface imperfection composite surface. In doing so, the grouting pans force trapped air out of and mortar into of the pin holes and surface voids. In particular, the sidewall pushes the mortar into the surface imperfections, while the rounded edge and the planar bottom surface compress the mortar in and force air out. This action also thoroughly mixes any filler with the mortar during grouting. The cured surface is finished to form a finished surface. The present grouting pan and specifically shaped reinforcement ring combination also creates aesthetically pleasing and ornamental benefits over prior designs.

The present assembly is advantageous over traditional devices. For example, a flexible metallic reinforcement layer or ring of the present apparatus advantageously allows greater and more even floor contact over worn areas and cracks due to pan-to-pan flexibility, which is expected to improve grout-filling performance. Furthermore, the post extending from each pan and method of manufacturing the apparatus advantageously provide a more secure attachment of components. The flexible metallic reinforcement ring, in combination with metallic grouting pans, provide enhanced durability and improved heat dissipation during use. Moreover, the present ring enhances pad stiffness adjacent its periphery which gives more even pan-to-floor pressure.

Additional advantages and features of the present invention will be readily understood from the following description, claims and appended drawings.

DETAILED DESCRIPTION

Figure 1:
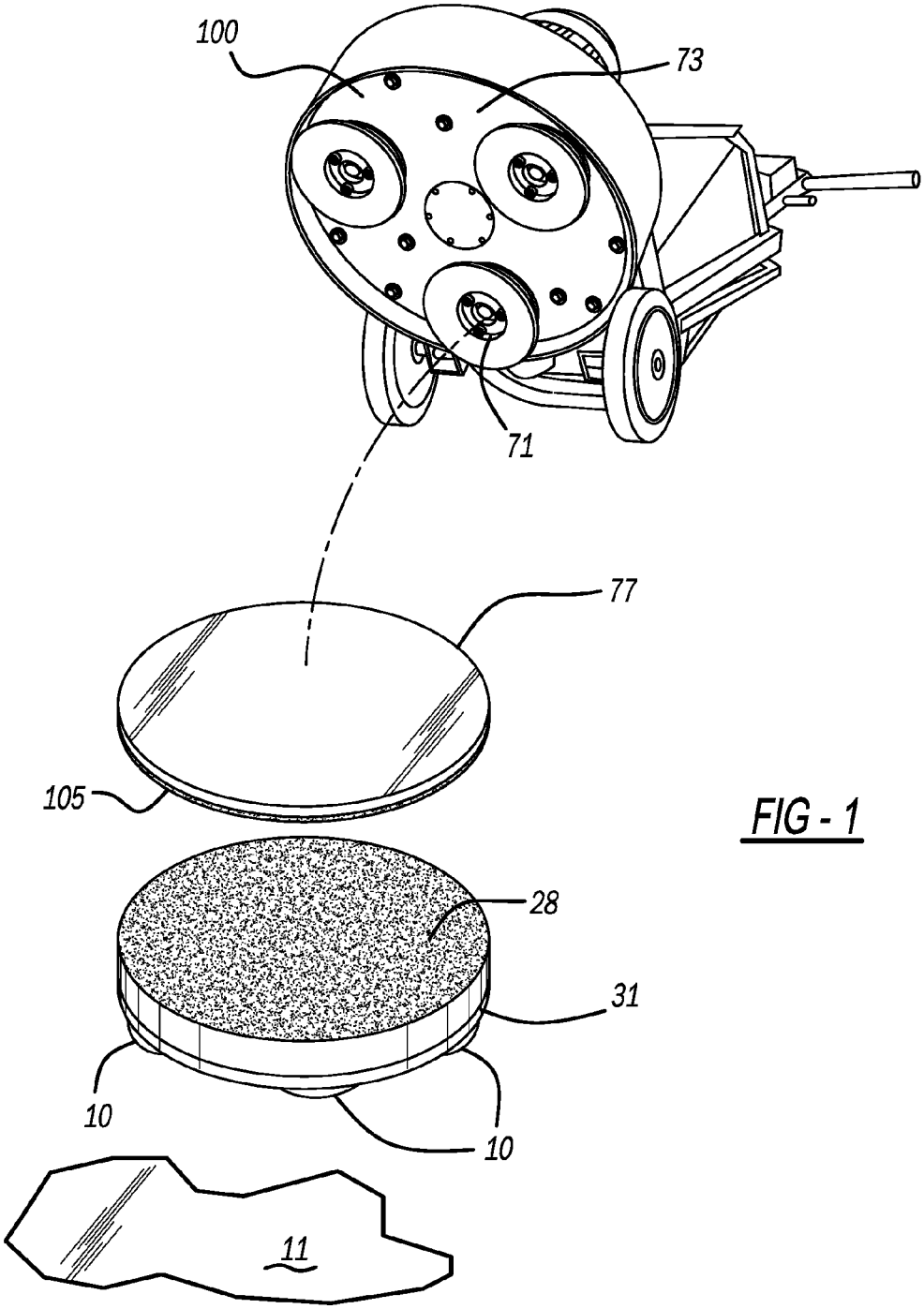
FIG. 1 is a partially exploded top perspective view showing a grouting pan assembly including a powered finishing machine.

A grouting pan assembly 34 includes a rubber or elastomeric polymer base pad or layer 28, a reinforcement ring or layer 31 and multiple grouting pans 10 for finishing a composite floor or workpiece surface 11. This can be observed in FIGS. 1-6 and 8. The grouting pan 10 has a substantially planar bottom surface 12, and a curved sidewall 14 surrounding the bottom surface 12. The curved sidewall 14 is defined by an angled portion 16 and a rounded edge portion 18. The curved sidewall 14 may further include a vertical portion 20 extending from the angled portion 16 to a top backside surface 22. In a preferred embodiment, the grouting pan 10 is metal and more preferably stainless steel.

The reinforcement ring or layer 31 is secured to a bottom face or surface 40 of base pad 28, by a contact cement type of adhesive. The reinforcement ring 31 is generally annular having a central opening with an inner diameter of approximately 110 mm and an outer diameter of approximately 229 mm for one version of the assembly. Furthermore, the reinforcement ring 31 has a thickness greater than zero and up to 1.0 mm, and more preferably 0.25 mm. The reinforcement ring or layer 31 is metallic and more preferably a high carbon 1095, hardened and tempered spring steel material. The reinforcement ring 31 reinforces and adds some radial stiffness and toughness to the outer portion of the pad 28 to resist rotational centrifugal forces when used, however, the ring advantageously allows a significant amount of torsional and longitudinal flexibility and resilience to assembly 34 so it can flex with and follow any floor imperfections thereby producing uniform pan-to-pan floor contact for grouting. This is especially beneficial when worn areas of the floor or cracks in the floor are otherwise encountered by only some pans but not others.

The circular internal edge 33 of the reinforcement ring 31 defines the central opening or hole which exposes a central surface of the base pad 28. This large diameter internal edge 33 allows for easier torsional flexure of the ring during use. The base pad 28 and the ring 31 preferably have concentrically aligned circular peripheral surfaces 39 and 41, respectively.

Alternately, the variations of reinforcement rings 31*a-d* may have wavy or undulating inner edges 33*a-d* such as that shown in FIGS. 9-12. These curved inner edges have radially extending slots 61*a-d* between radially enlarged pan-mounting peaks 63*a-d* allowing for different flexibility characteristics of the ring. Nevertheless, these ring edge shapes also provide aesthetically pleasing ornamental designs.

Figure 7:
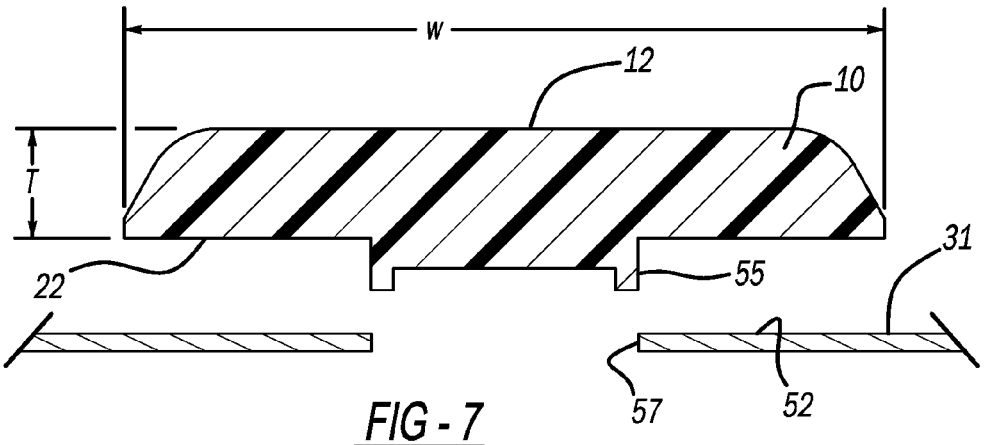
FIG. 7 is an exploded cross-sectional view, taken along line 8-8 of FIG. 5, showing the present grouting pan and a reinforcement ring.
Figure 8:
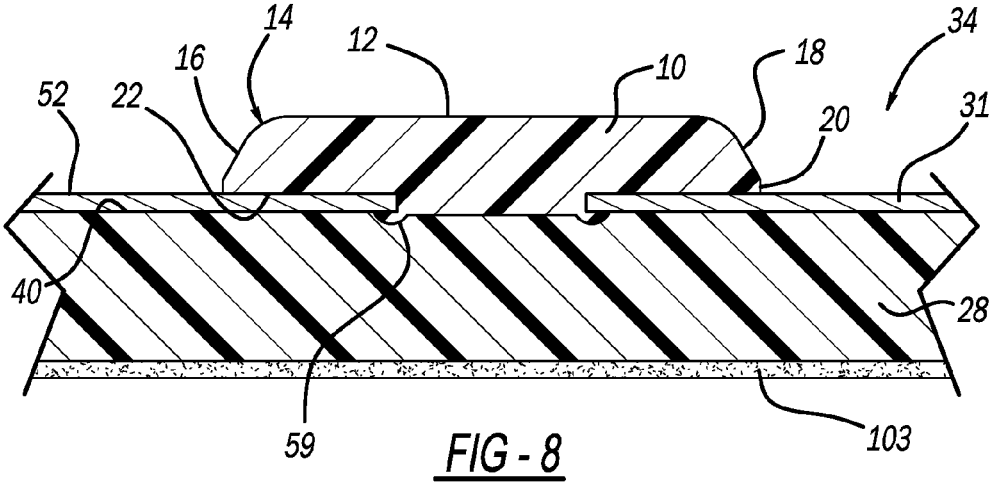
FIG. 8 is a cross-sectional view, taken along line 8-8 of FIG. 5, showing the present grouting pan assembly.
Figure 9:
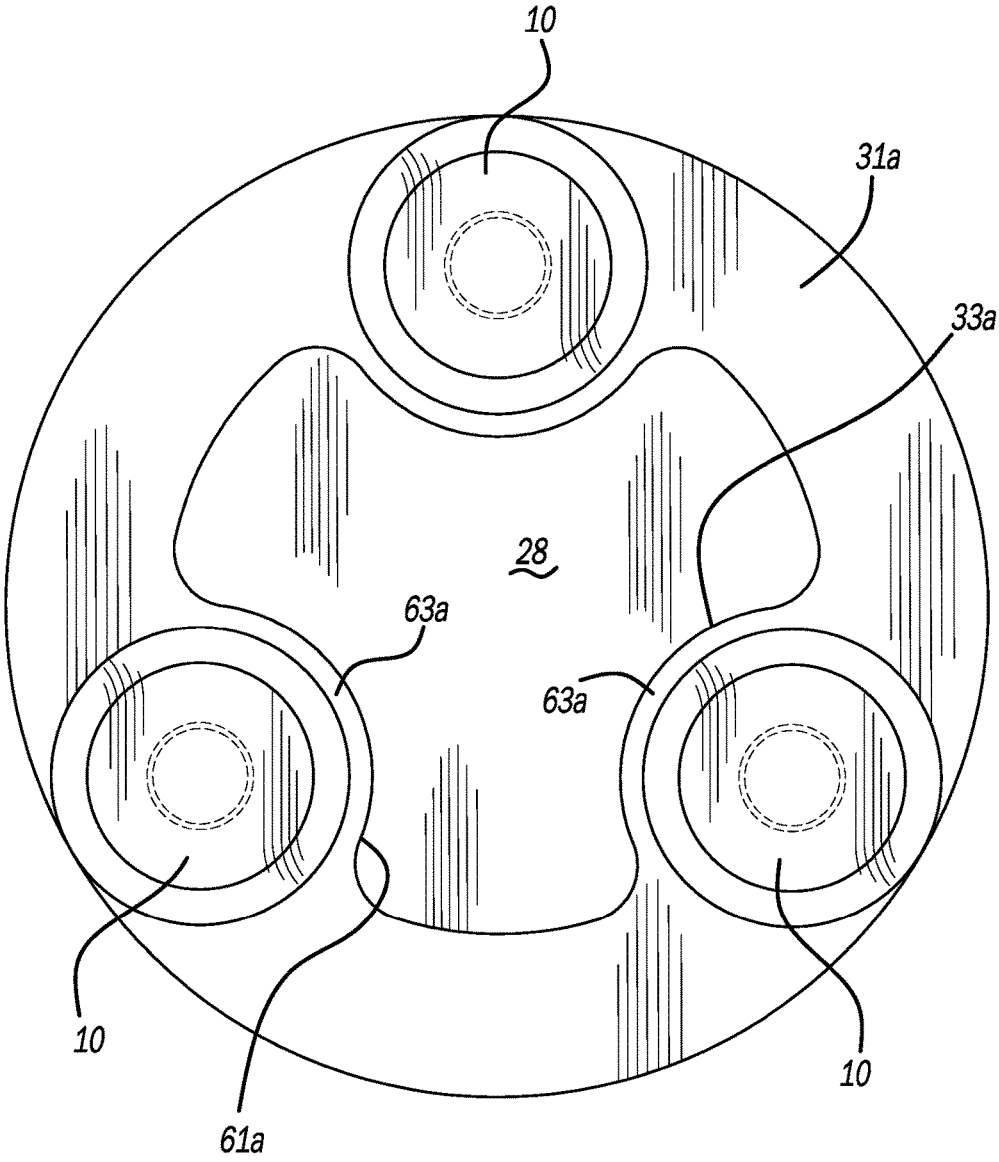
FIG. 9 is a bottom elevational view, showing an alternate embodiment of the present grouting pan assembly.
Figure 10:
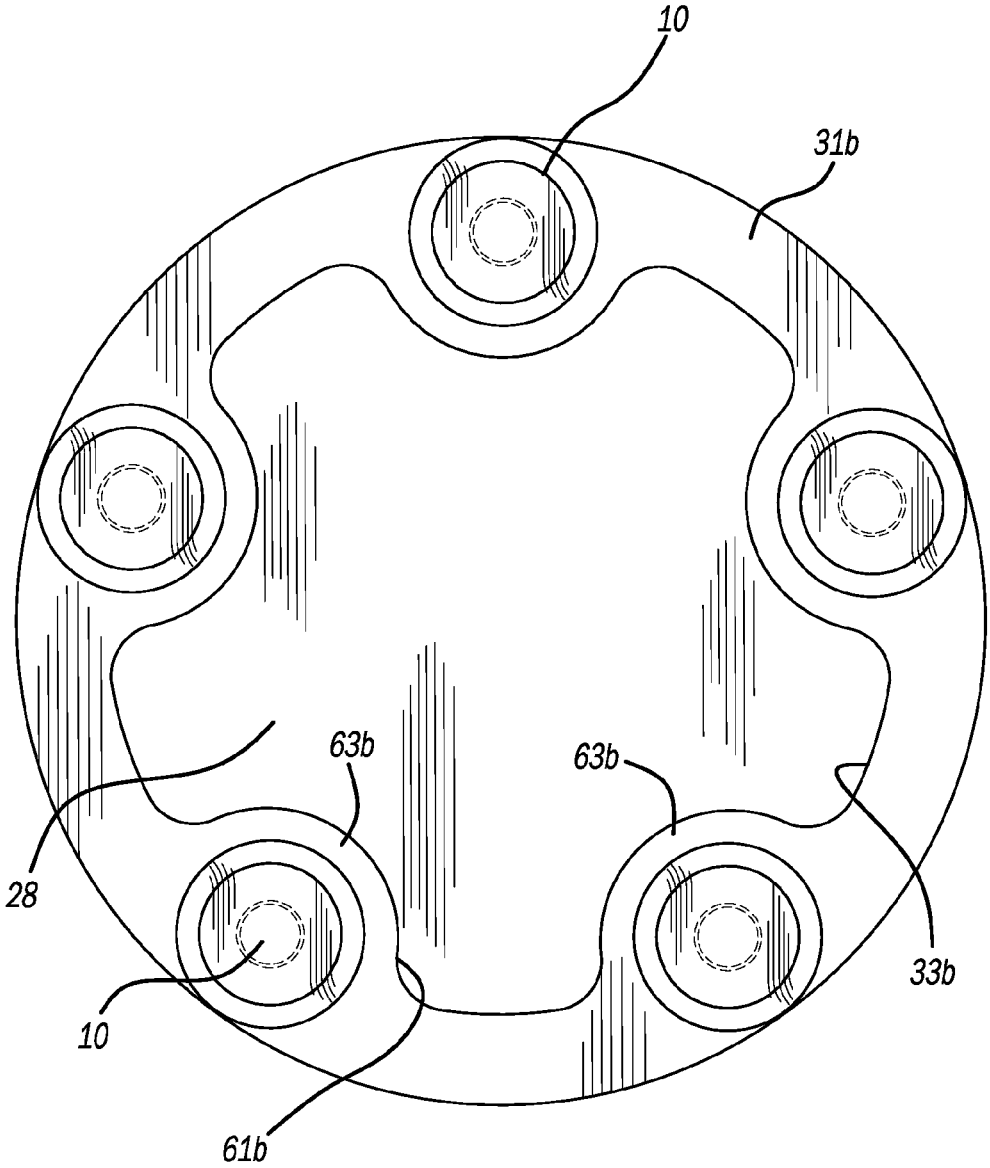
FIG. 10 is a bottom elevational view, showing another alternate embodiment of the present grouting pan assembly.
Figure 11:
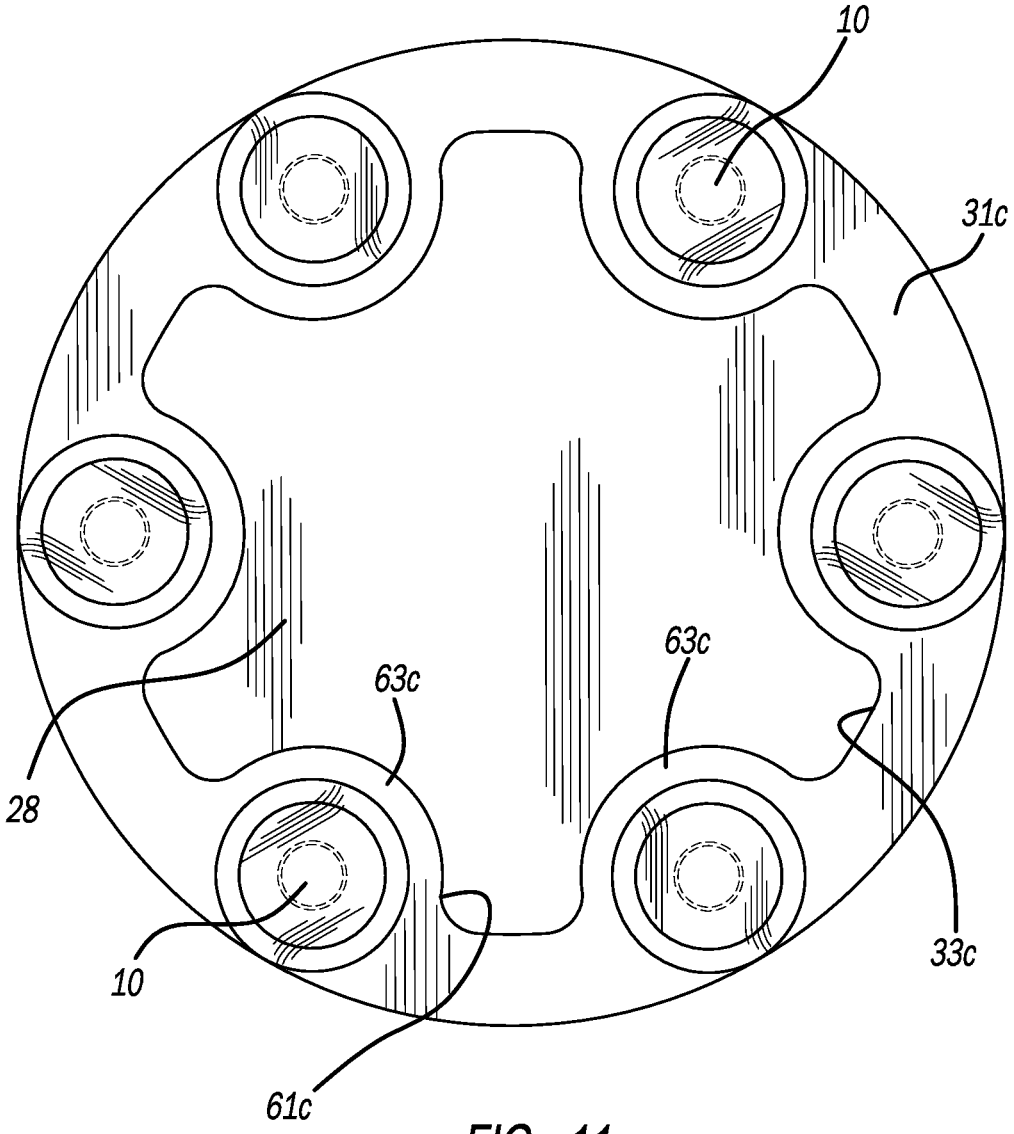
FIG. 11 is a bottom elevational view, showing yet another alternate embodiment of the present grouting pan assembly.
Figure 12:
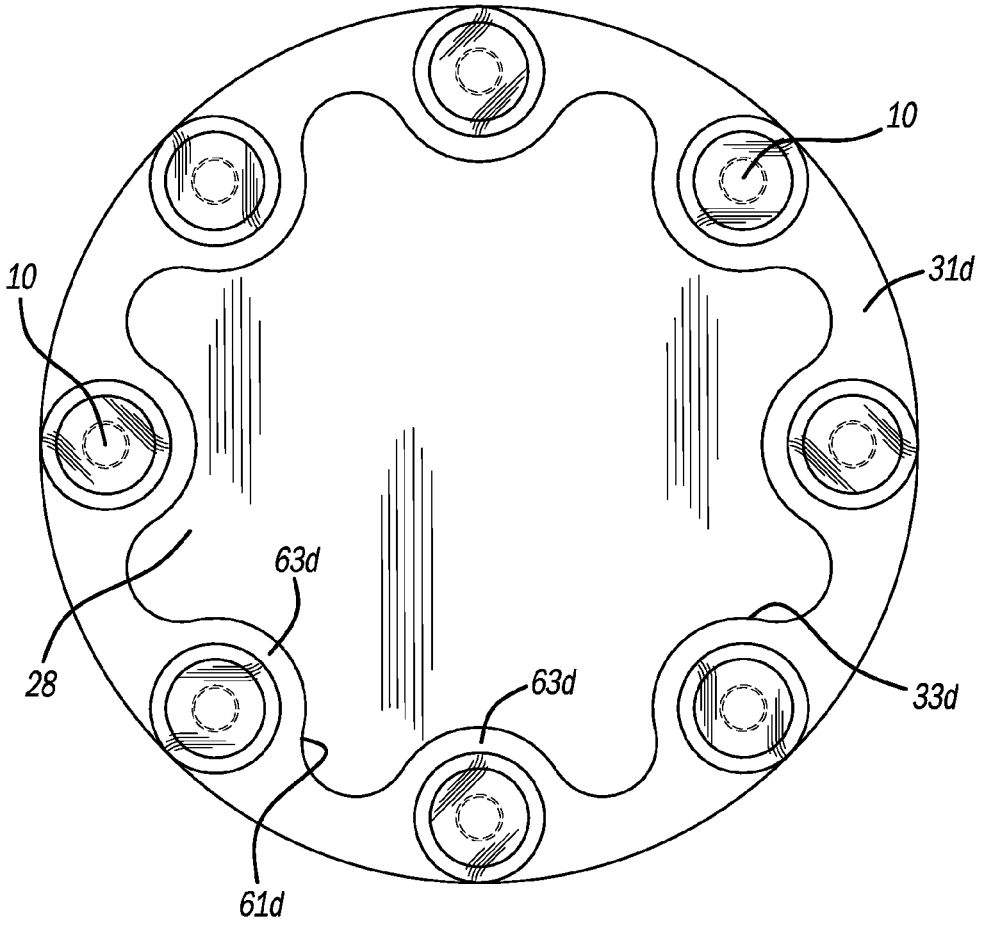
FIG. 12 is a bottom elevational view, showing a further alternate embodiment of the present grouting pan assembly.

Referring to FIGS. 7 and 8, the floor-contacting pans 10 are secured to a bottom and floor-facing surface 52 of the reinforcement ring 31. Each pan includes a generally circular body with an exemplary outer peripheral diameter of 54 mm and a total height below the reinforcement ring 31 of 8.0 mm. Thus, each pan is at least twice as laterally wide W as longitudinally tall T and more preferably at least five times as wide as tall (exposed below the ring).

An optional and cylindrically shaped post 55 projects from a backside of each disk-like pan in a longitudinal direction substantially parallel to a rotational axis of the pad apparatus, and is integrally formed therewith as a single piece. The post 55 is approximately 20 mm wide and between approximately 1.0 mm long. Furthermore, the post 55 projects through an aperture 57 pierced in the ring 31. Multiple of the apertures are equally spaced apart in the ring. A distal end of the post 55 is deformed and crimped to outwardly expand like a mushroom head thereby creating an enlarged head 59 (as shown in FIG. 8) which is laterally larger than the aperture 57. FIG. 7 shows the post 55 before deformation. Thus, the ring 31 is sandwiched and compressed between the head 59 and the backside of each pan 10 to mechanically attach and secure the pans 10 to the ring 31.

Adhesive may additionally or instead be employed to attach and secure the pans 10 to the ring 31 with or without the posts, depending on the specific durability requirement and coarseness of the grit for grinding. While four grouting pans are preferably attached to the reinforcement ring, at least two pans (such as three, six or more) may alternately be used with each ring. Alternately, the post may be a longitudinally elongated threaded shaft of a bolt or other mechanical fastener, although some of the benefits of the preferred integral post may not be achieved.

It is alternately envisioned that multiple parallel and spaced apart posts may project from each disk-like pan for insertion onto aligned apertures of the reinforcement ring. Moreover, it is alternately envisioned that one or more posts can have a generally polygonal shape, a flat side surface or a greater width in one lateral direction than another (e.g., a rectangle or oval). These alternate post configurations deter rotation of the pans relative to the attached reinforcement ring and base pad during grouting. In the example shown, four such pans 10 are secured about the circumference of the reinforcement ring 31 in an equally spaced apart manner. The posts may be solid or at least partially hollow. Different sizes and/or a different quantity of the pans may alternately be used. Furthermore, the ring apertures 57 are preferably circular but may alternately have one or more flat edges, or even be elongated slots in the inner or outer edges 33 and 41, respectively, of the ring 31.

Figure 2:
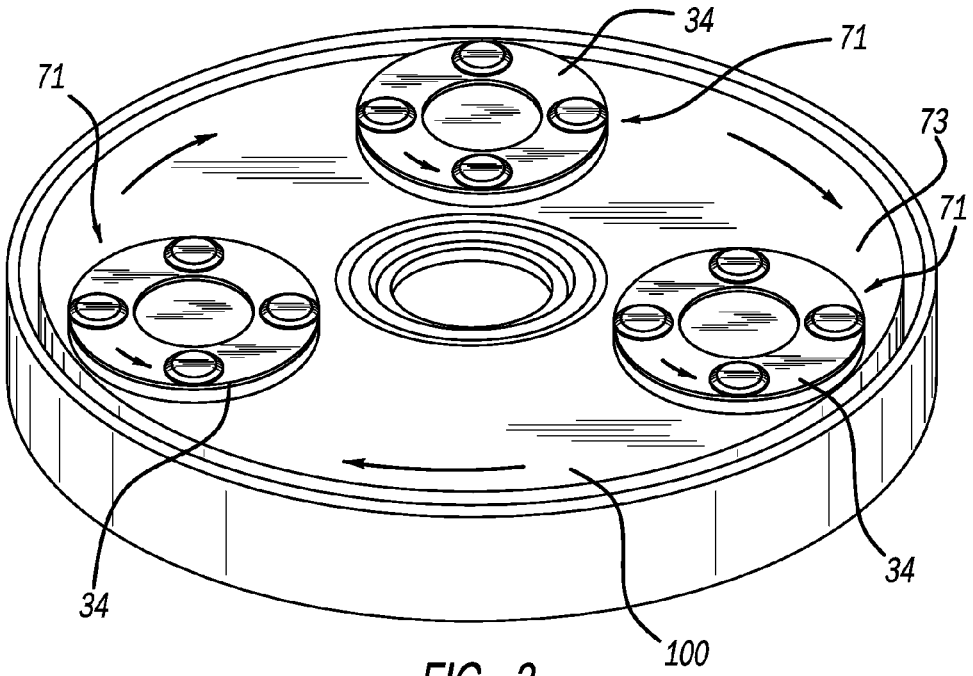
FIG. 2 is a bottom perspective view showing several of the present grouting pan assemblies affixed to a counter-rotating head of the powered finishing machine.
Figure 3:
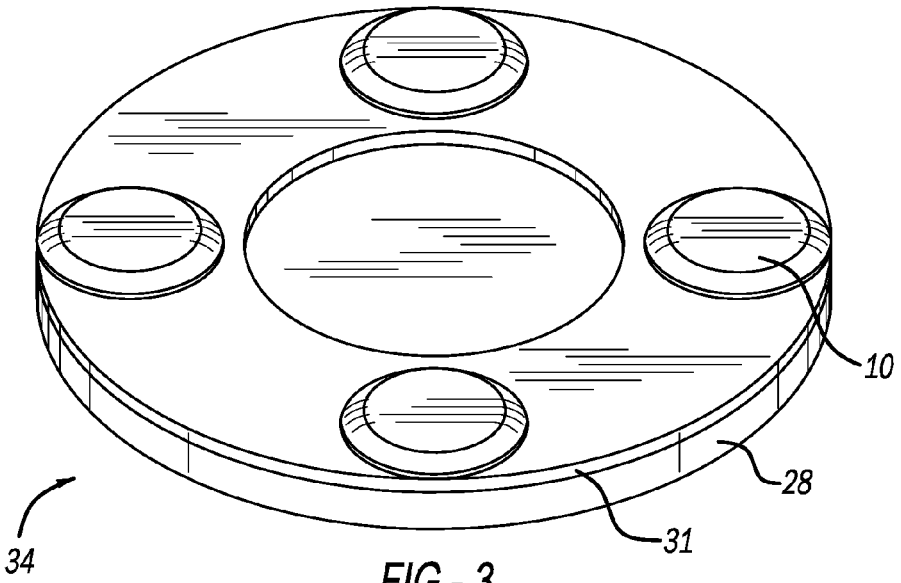
FIG. 3 is a bottom perspective view showing the present grouting pan assembly.
Figure 4:
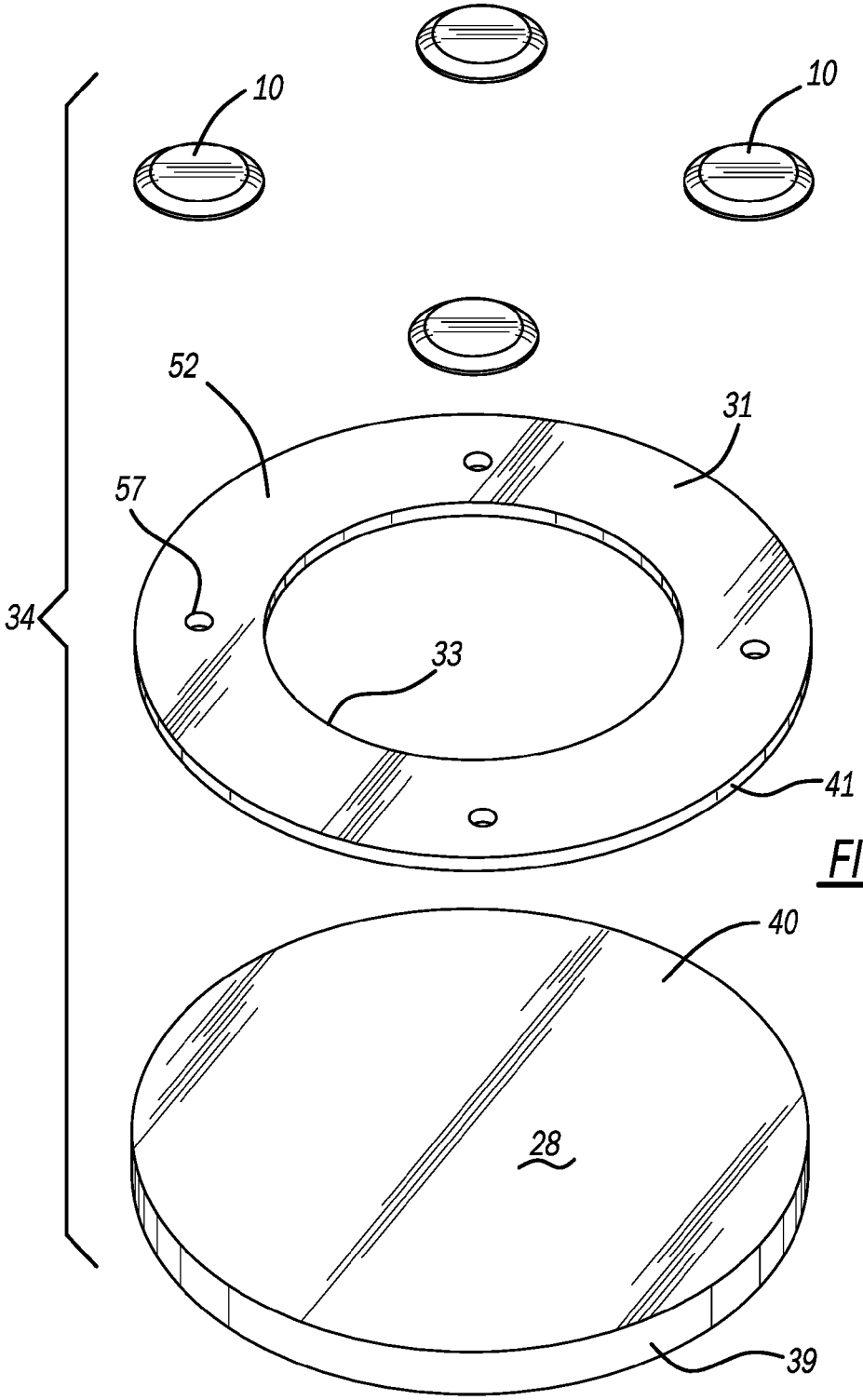
FIG. 4 is a bottom exploded perspective view showing the present grouting pan assembly.

FIGS. 1 and 2 show one of multiple pan assemblies 34 secured to a rotatable flanged hub 71 of a larger counter-rotating rotor 73 of an electric motor-powered floor grinding machine 75. A hard rubber or elastomeric polymer disk 77 includes a plurality of clips or bolt-receiving holes for releasably securing the disk 77 to the hub 71. A layer of hook-and-loop fasteners 103 (e.g. Velcro®) may be secured to the bottom of the disk 77 and can be removably secured to the base pad 28; however, it is also envisioned that the pad 28 may be directly attached to the hub 71 in some constructions. A plurality of the grouting pan assemblies 34 are secured for rotation about a central axis of the rotor 73. Alternate powered machines and pad attachments may be used. Also, the present pad assembly may be attached to a walk-behind or riding power-trowel machine which may be propane fuel powered.

Figure 5:
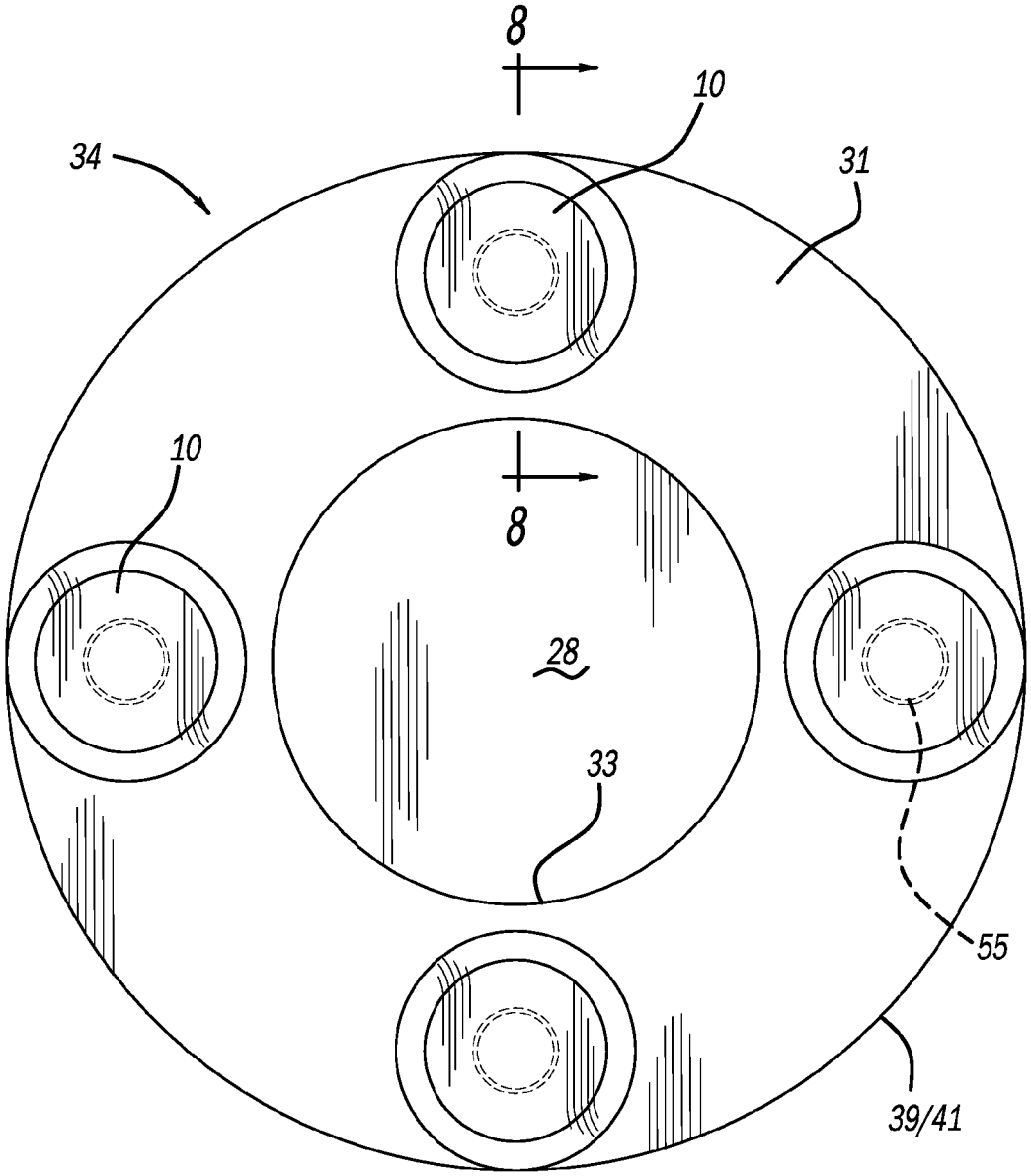
FIG. 5 is a bottom elevational view showing the present grouting pan assembly.
Figure 6:
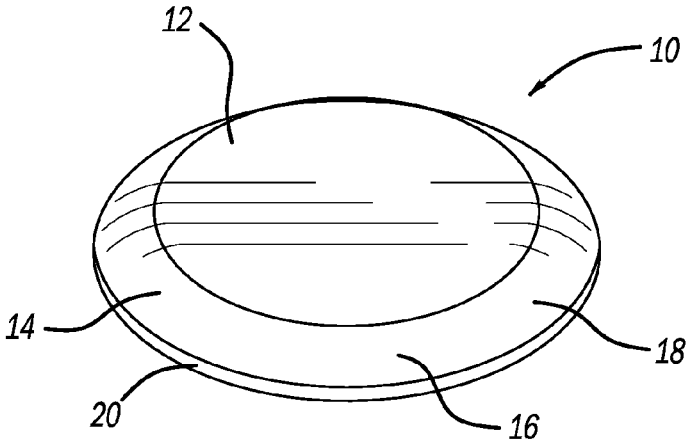
FIG. 6 is a bottom perspective view of the present grouting pan.

With particular reference to FIGS. 1 and 2, the grouting pan assembly 34 shown in FIG. 5 is well suited for use on the finishing or grinding machine having the rotary head 73 supporting the set of counter-rotating planets or hubs 71. For example, a grouting pan assembly 34 (three being shown) is affixed to an associated counter-rotating planet 71 which rotates in a direction opposite the rotary head 73. Additional grouting pan assemblies 34 may be affixed to counter-rotating planets 71 as needed for a particular application. During operation of the finishing machine, the head 73 rotates the grouting pan assemblies 10 in a clockwise direction as the planets 71 rotate each assembly 10 in a counterclockwise direction relative to the head 73 over the prepped surface for troweling the mortar onto the rough composite surface and forcing the mortar into the surface voids to form a grouted surface.

As presently preferred, the geometry of the grouting pan 10 is configured to efficiently spread mortar over the rough cut layer. During operation of the finishing machine, the heads rotate the grouting pans 10 over the prepped surface for troweling the mortar onto the rough composite surface with the sidewalls 14 and forcing the mortar into the surface voids with the bottom surface 12 to form a grouted surface.

A method for finishing a composite floor surface will now be described. While the method described herein has a specific application for grouting a terrazzo floor, the process has broader utility for finishing or re-finishing any composite surface including but not limited to epoxy, terrazzo, or cementitious surface with or without decorative aggregates. Initially, it is understood that a rough composite surface has been prepared in accordance the conventional method described in the background above with the following exception. The method described hereafter, and in particular the method for grouting the rough composite surface enables the use of a finer grit during the rough cut process than the very course or course grit used in conventional finishing. In particular, the rough composite surface may be finished to a 150-grit or 200-grit surface prior to grouting.

The method for finishing a composite surface includes spreading a mortar over the rough composite surface having surface voids to form a prepped surface. Optionally, a filler may be broadcast on top of the mortar when forming the prepped surface. The filler may be a very fine powder of pulverized stone (e.g., marble, lime stone, granite and/or quartz), calcium carbonate or cement. The grouting pans are rotated over the prepped surface such that the curved sidewalls trowel the mortar onto the rough composite surface and the bottom surface 12 which is in contact with the prepped floor forces the mortar into the surface voids such that a grouted surface is formed. The mortar on the grouted surface is allowed to cure such that a cured surface is formed. Then, the cured surface is ground to remove excess grout and finished using to a fine grit finish on the order of 200-grit or higher, then sealed and polished such that a finished surface is formed. The grouting pans 10 described herein are particularly well suited for use on a rotating head of a finishing machine when practicing the method described above.

While various embodiments have been disclosed, it should be appreciated that additional variations of the grouting pad assembly are also envisioned. For example, while preferred dimensions and metallic materials have been disclosed hereinabove, it should alternately be appreciated that other dimensions and metallic materials may be employed. By way of example, the reinforcement ring may be made from a polymeric material although the heat sink benefits of the preferred metallic ring may not be obtained. Moreover, circular peripheral shapes for the pad, reinforcement ring and pans are preferred; however, other arcuate or even generally polygonal peripheral shapes may be used although certain of the present advantages may not be fully realized. Alternate base pads 25 may be used, such as fiber, foam, felt or other such flexible materials. It is also noteworthy that any of the preceding features may be interchanged and intermixed with any of the others. Furthermore, it is alternately feasible to have a differently shaped inner edge or even no central hole in the reinforcement ring or layer, although the torsional flexure may be inadequate for some uses, and there may be undesired extra material costs and weight with such. Accordingly, any and/or all of the dependent claims may depend from all of their preceding claims and may be combined together in any combination. Variations are not to be regarded as a departure from the present disclosure, and all such modifications are entitled to be included within the scope and spirit of the present invention.

What is claimed is:

1. A grouting pan assembly comprising:

(a) a rotatable pad including a top surface, a floor-facing bottom surface and a peripheral surface;

(b) a reinforcement layer attached to the bottom surface of the pad, the reinforcement layer being a flexible material; and (c) grouting pans attached to a floor-facing surface of the reinforcement layer.

2. The assembly of claim 1, wherein each of the grouting pans comprises at least one mechanical fastener projecting from a backside thereof.

3. The assembly of claim 2, wherein the fastener includes a post, each of the posts extends through an associated aperture in the reinforcement layer, and a distal end of each of the posts is laterally expanded on an upper side of the reinforcement layer to mechanically attach the associated grouting pan to the reinforcement layer.

4. The assembly of claim 1, wherein each of the grouting pans includes a floor-facing bottom surface and a curved sidewall connected to the bottom surface of the pan, the curved sidewall includes an angled portion and a rounded edge portion between the bottom surface and the angled portion such that an obtuse included angle is formed therebetween.

5. The assembly of claim 4, wherein the included angle is 110°-135°.

6. The assembly of claim 1, wherein the reinforcement layer is an annular ring having circular inner and outer edges, and a central portion of the pad is exposed through a hole defined by the inner edge of the ring.

7. The assembly of claim 1, wherein the flexible material of the reinforcement layer is metallic.

8. The assembly of claim 1, wherein:

the pad includes a rubber or elastomeric material; and the reinforcement layer provides radial stiffness and torsional flexibility such that one of the grouting pans may longitudinally move relative to another of the grouting pans.

9. The assembly of claim 1, wherein the reinforcement layer is a metallic ring and the grouting pans are metallic such that the reinforcement layer acts as a heat sink for the pans.

10. The assembly of claim 1, further comprising:

an electrically or fuel powered machine adapted to simultaneously rotate multiples of the pad to grind a concrete, stone or terrazzo floor;

the reinforcement layer allowing flexure so that all of the grouting pans can contact the floor even when uneven floor conditions are encountered; and the reinforcement layer having a thickness no greater than 1 mm.

11. The assembly of claim 1, wherein:

the peripheral surface of the pad is circular;

the pad is flexible;

a peripheral surface of the reinforcement layer is substantially circular and has substantially a same diameter as that of the pad which are at least 7 inches; and peripheries of the grouting pans are substantially circular with a diameter of 1.5-2.5 inches.

12. The assembly of claim 1, wherein:

there are at least four of the grouting pans, which are metallic, and the grouting pans are attached to the reinforcement layer, which is metallic; and the pad and reinforcement layer have circular peripheries.

13. The assembly of claim 1, further comprising grout pushed into voids in a surface of a composite or cement floor by rotation of the grouting pan.

14. The assembly of claim 1, wherein an inner edge of the reinforcement layer has an undulating shape with the grouting pans located in radially enlarged peaks thereof between which are radially extending slots.

15. A grouting pan assembly comprising:

(a) a flexible pad;

(b) a metallic reinforcement ring attached to the pad;

(c) metallic grouting pans attached to the ring;

(d) an electrically powered machine adapted to rotate the grouting pans to push grout into voids in a concrete, stone or terrazzo floor; and (e) the ring being adapted to torsionally flex for allowing all of the grouting pans to contact against the floor even when uneven floor conditions are encountered.

16. The assembly of claim 15, further comprising at least one post projecting from a backside of each of the grouting pans.

17. The assembly of claim 16, wherein each of the posts is integrally connected as a single piece with the associated grouting pan, and the posts assist in fastening the grouting pans to the ring.

18. The assembly of claim 15, wherein the ring is annular with circular inner and outer edges, and a central portion of the pad is exposed through a hole defined by the inner edge of the ring.

19. The assembly of claim 15, wherein an inner edge of the reinforcement ring has an undulating shape with the grouting pans located in radially enlarged peaks thereof.

20. The assembly of claim 15, further comprising hook-and-loop fasteners removably securing the pad to a rotatable head of the machine, and the pad is an elastomeric polymer or rubber material with a circular periphery.

21. An apparatus comprising:

(a) a rotatable flexible pad including a top surface, a floor-facing bottom surface and a circular peripheral surface;

(b) a reinforcement layer, with a circular periphery, attached to the bottom surface of the pad, the reinforcement layer including multiple apertures; and (c) floor-contacting grouting pans each comprising at least one post projecting from a backside thereof, each of the posts extending through an associated one of the apertures in the reinforcement layer, each of the grouting pans including a circular periphery.

22. The apparatus of claim 21, wherein the grouting pans are metal, and the pad is an elastomeric polymer or rubber material.

23. The apparatus of claim 21, wherein the grouting pans push grout into voids in a concrete, stone or terrazzo floor when the grouting pans are rotated.

24. The apparatus of claim 21, wherein a distal end of each of the posts is laterally expanded on an upper side of the reinforcement layer to mechanically attach the associated grouting pan to the reinforcement layer.

25. The apparatus of claim 21, wherein:

each of the grouting pans comprise a solid body including a floor-facing flat bottom and a tapered sidewall; and the post is an integral single piece with the body.

26. The apparatus of claim 21, wherein a lateral width of each of the posts is at least twice that of a projecting longitudinal length of each of the posts.

27. The apparatus of claim 21, wherein:

the reinforcement layer is an annular ring having circular inner and outer edges, and a central portion of the pad is exposed through a hole defined by the inner edge of the ring; and the reinforcement layer is a flexible metallic material.

28. A grouting pan assembly comprising:

(a) a flexible and rotatable pad including a floor-facing surface and a circular peripheral surface;

(b) a reinforcement layer attached to the floor-facing surface of the pad, the reinforcement layer being stiffer than the pad but being flexible, the reinforcement layer being thinner than the pad, and the reinforcement layer including a central hole through which a portion of the pad is exposed; and (c) metallic grouting pans attached to a floor-facing side of the reinforcement layer, each of the grouting pans including a circular periphery.

29. The assembly of claim 28, wherein each of the grouting pans comprises at least one mechanical fastener projecting from a backside thereof.

30. The assembly of claim 29, wherein the fastener includes a post, each of the posts extends through an associated aperture in the reinforcement layer, and a distal end of each of the posts is laterally expanded on an upper side of the reinforcement layer to mechanically attach the associated grouting pan to the reinforcement layer.

31. The assembly of claim 28, wherein each of the grouting pans includes a floor-facing bottom surface and a curved sidewall connected to the bottom surface of the pan, the curved sidewall includes an angled portion and a rounded edge portion between the bottom surface and the angled portion such that an obtuse included angle is formed therebetween.

32. The assembly of claim 28, wherein the reinforcement layer is metallic.

33. The assembly of claim 28, wherein:

the pad includes a rubber or elastomeric material; and the reinforcement layer provides radial stiffness and torsional flexibility such that one of the grouting pans may move relative to another of the grouting pans.

34. The assembly of claim 28, further comprising:

an electrically or fuel powered machine adapted to simultaneously rotate multiples of the pad to grind a concrete, stone or terrazzo floor;

the reinforcement layer allowing flexure so that all of the grouting pans can contact the floor even when uneven floor conditions are encountered; and the reinforcement layer having a thickness no greater than 1 mm.

35. The assembly of claim 28, wherein an inner edge of the reinforcement layer has an undulating shape with the grouting pans located in radially enlarged peaks thereof between which are radially extending slots.

* * * * *